United States Patent [19]

Beck et al.

[11] 4,276,603

[45] Jun. 30, 1981

[54] DIFFUSION FURNACE MICROCONTROLLER

[75] Inventors: Martin A. Beck, South Londonderry, Vt.; John H. Fabricius, Tyngsboro, Mass.; Donald G. Landis, Milford, N.H.

[73] Assignee: BTU Engineering Corporation, North Billerica, Mass.

[21] Appl. No.: 89,631

[22] Filed: Oct. 30, 1979

[51] Int. Cl.[3] ..... G06F 15/46; G05B 23/30

[52] U.S. Cl. ..... 364/477; 219/486; 219/497; 236/15 BC; 236/78 B; 364/120; 364/107; 364/557; 432/36

[58] Field of Search ..... 364/477, 107, 105, 557, 364/468, 469, 120; 236/15 BC, 15 BF, 78 B; 219/483, 486, 497, 494, 137.7, 137.71; 13/20, 24, 34, 33, 2 R; 432/36, 45, 51

[56] References Cited

U.S. PATENT DOCUMENTS

| | | | |
|---|---|---|---|
| 3,315,063 | 4/1967 | Ihlenfeldt | 219/497 |
| 3,319,887 | 5/1967 | Gallagher | 236/15 BF |
| 3,370,120 | 2/1968 | Lasch, Jr. | 236/15 BF |
| 3,387,078 | 6/1968 | Montgomery, Jr. et al. | 13/24 |
| 3,723,053 | 3/1973 | Myers et al. | 432/45 X |
| 4,004,138 | 1/1977 | Morooka et al. | 364/477 X |
| 4,011,430 | 3/1977 | Witkin et al. | 219/483 X |

*Primary Examiner*—Joseph F. Ruggiero
*Attorney, Agent, or Firm*—Weingarten, Maxham & Schurgin

[57] ABSTRACT

An automatic microprocessor-based control system for a diffusion furnace in which the controller is dedicated to a single associated diffusion tube to provide all monitoring and control functions necessary for a variety of diffusion processes. The controller provides direct digital control of time, temperature and gas flow, and can be readily operated with a variety of control algorithms.

21 Claims, 7 Drawing Figures

DIFFUSION FURNACE MICROCONTROLLER

FIELD OF THE INVENTION

This invention relates to furnace control systems and more particularly to diffusion furnace control by means of a dedicated microprocessor-based automatic controller.

BACKGROUND OF THE INVENTION

In a diffusion furnace for the processing of semiconductor wafers, a batch of wafers is introduced into the diffusion tube of the furnace and is subjected to a cycle composed of several intervals of time at predetermined temperatures and gas concentrations. Control of such diffusion processes have been accomplished by semi-automatic means whereby time, temperature and gas flow for each of a succession of time intervals are preset and maintained by known open and closed loop control circuits. Such semi-automatic control techniques are not very versatile and are often limited in the precision of control which can be achieved. Automatic control of diffusion processes has been proposed using a general purpose computer in association with a large number of diffusion tubes to provide, on a time-shared basis, monitoring and control of the several tubes in the overall diffusion facility. The use of a general purpose computer for control of less than a relatively large number of diffusion tubes is not economically realistic in most instances. By reason of the time sharing of a single computer, some process parameters cannot be readily controlled to the required extent. Moreover, any malfunction or interruption of the single computer can result in shutdown of the entire multiple tube diffusion facility, with serious consequences to the production of semiconductor wafers.

SUMMARY OF THE INVENTION

Briefly, the present invention provides an automatic microprocessor-based control system for a diffusion furnace wherein the controller is dedicated to a single associated diffusion tube to provide all monitoring and control functions necessary for a variety of diffusion processes. The system employs a solid-state microprocessor, associated random access memory (RAM) and read-only memory (ROM), and means for communication with the operating front panel which can be remotely located. The controller provides direct digital control of time, temperature and gas flow, and can be operated with a variety of control algorithms.

DESCRIPTION OF THE DRAWINGS

The invention will be more fully understood from the following detailed description taken in conjunction with the accompanying drawings in which.

DETAILED DESCRIPTION OF THE INVENTION

Figure 1:
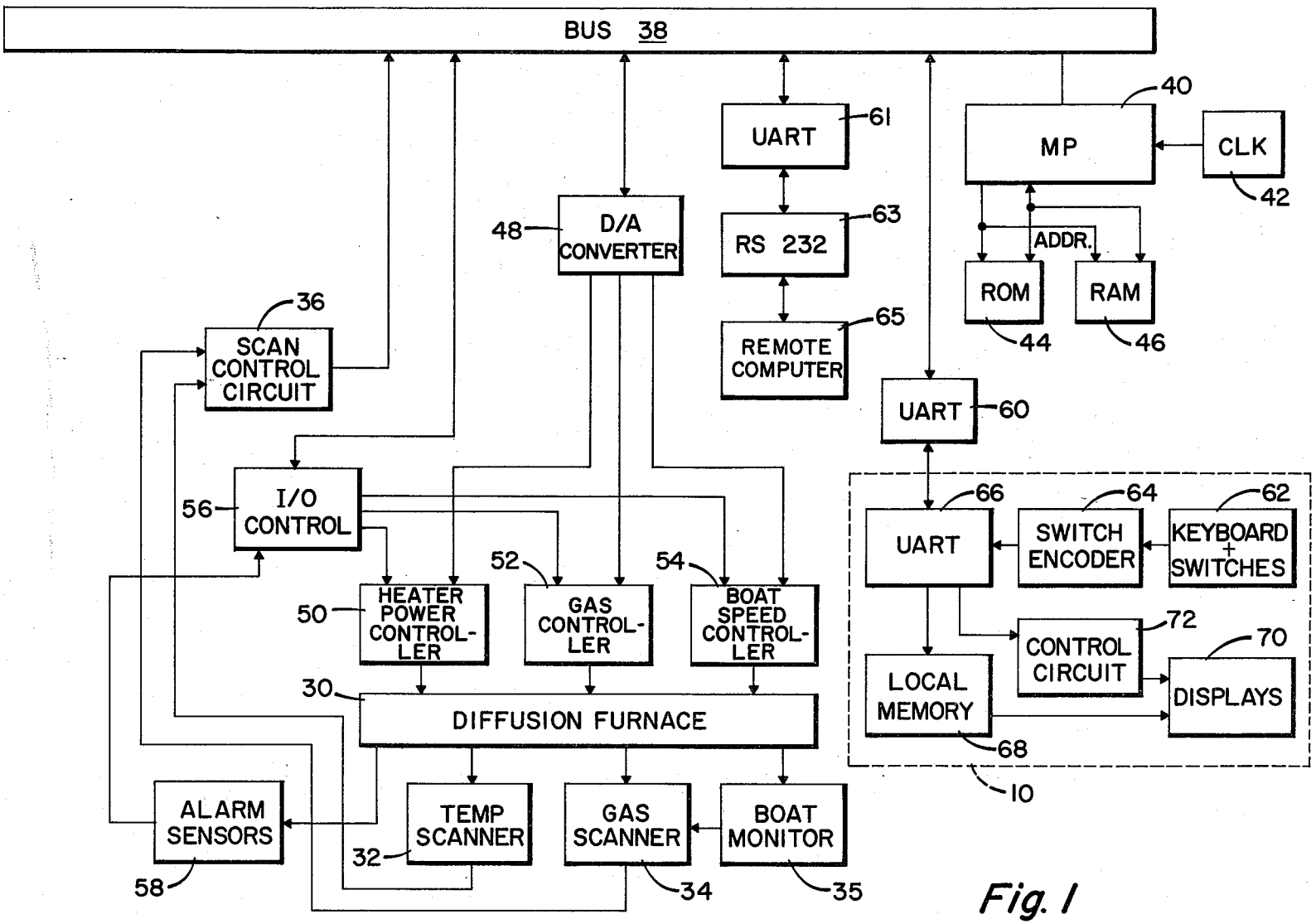
FIG. 1 is a block diagram of a diffusion furnace microcontroller according to the invention.

The microcontroller system is shown in block diagram form in FIG. 1. A diffusion furnace 30 has temperature sensors therein connected to a temperature scanner 32, and gas flow monitors connected to a gas scanner 34. The scanners 32 and 34 are coupled to scan control circuitry 36 which is coupled via a communications bus 38 to a microprocessor 40 which includes a clock 42, read-only memory (ROM) 44, and random access memory (RAM) 46. A digital-to-analog (D/A) converter 48 receives digital data via bus 38 and provides analog control signals to a heater power controller 50, a gas controller 52 and a boat speed controller 54.

Heater controller 50 includes SCRS or similar triggered solid state devices to power the heaters of the diffusion furnace for control of furnace temperature in the respective zones. The controller can be driven from varying analog signals from converter 48, or pulses from input/output control 56 which are of varying width. The gas controller 52 provides signals for regulation of gas flow in the furnace. The boat speed controller 54 provides control signals for governing speed of boat movement through the furnace. A boat monitor 35 can be provided to sense actual boat position or movement through the furnace for closed-loop control of boat movement. The input/output (I/O) control 56 is operative in response to data received from bus 38 to enable respective controller 50, 52 and 54. Diffusion furnace 30 can also include alarm sensors 58 operative to sense different alarm conditions and to provide a signal indication thereof to the microprocessor 40 via bus 38. Alarm conditions can also be sensed by monitoring the output level from the temperature and other control sensors in the furnace.

The microprocessor 40 is also coupled via its bus 38 to a universal asynchronous receiver-transmitter (UART) 60 which in turn is coupled to a system front panel 10 which can be remotely located. The front panel 10 includes a keyboard and operating switches 62 coupled to a switch encoder 64 which provides encoded signals representing switch actuation to a UART 66 which is coupled to UART 60. The UART 66 is also coupled to a local memory 68, which in turn is coupled to displays 70 which include indicators for numerical and status information. The UART 66 is also coupled to display 70 by way of a control circuit 72. The microprocessor can be coupled by means of a UART 61 and RS232 data interface 63 to a remote computer 65 for the loading of data from the microprocessor to the remote computer or the loading of data from the computer to the microprocessor.

Figure 7:
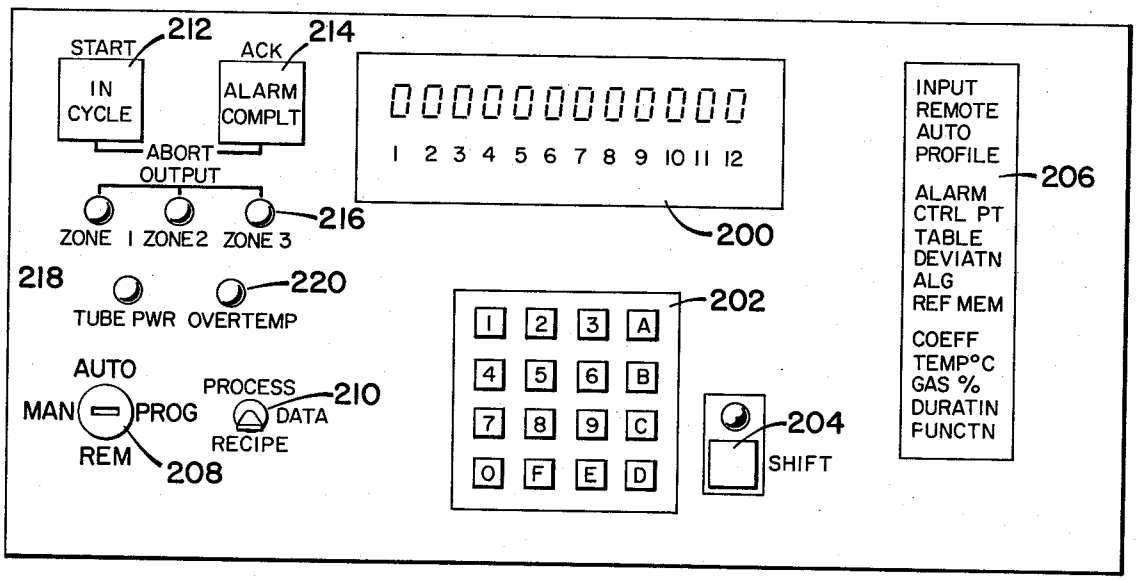
FIG. 7 is a pictorial view of the front panel controls and indicators of the novel microcontroller.

The front panel controls and indicators are shown in FIG. 7. A numerical display 200 is provided to indicate up to twelve characters of alphanumeric information. The sixteen-button keyboard 202 provides a means for operator entry of ten decimal digits and six letter codes. A shift button 204 serves as a shift control to permit additional entry of data from keyboard 202. An annunciator panel 206 is provided and labeled as shown and includes associated lamps or LED's which, upon illumination, denote the status or identity of the controller entry and display steps. A key switch 208 permits operator selection of the particular microcontroller operating mode. A switch 210 provides selection of process (optional) data or recipe (input) data for display. Illuminated controls 212 and 214 can be actuated simultaneously to abort furnace operation. Actuation of control 212 alone starts an operating cycle. Actuation of control 214 alone acknowledges an alarm on completion of a cycle. An alarm indication is also provided by control 214 upon such event, and a cycle-completed indication is provided by corresponding illumination of section of controls 212 and 214. Zone indicators 216 are provided for respective zones and indicate the status of power applied to the respective zone heaters. The zone indicators flash correspondingly with the power pulses applied to the associated heaters thereby to denote the rate of the applied power pulses. Indicator 218 also denotes that primary electrical power is applied to the process tube, while an indicator 220 provides an over-temperature indication.

The diffusion process employed in the fabrication of semiconductor devices and circuits is a batch process in which a quantity of semiconductor wafers is placed in a diffusion furnace and subjected to predetermined conditions of temperature and gas flow for specified times, after which the processed wafers are withdrawn from the furnace. In a typical diffusion cycle, the diffusion furnace provides a first gas environment of particular flow rate and initial temperature for a first time interval, and, during a second time interval, the temperature may increase or ramp up to a predetermined higher level which is maintained for a third interval, during which time a different gas environment can be provided. During a subsequent time interval, the temperature can ramp to a lower level, at which time the gas environment can again change. There is thus a need to control temperature in relation to time, gas flow in relation to time for one or more gases, and to control the time of entry and removal of products from the furnace for a process cycle. For uniformity of result and achievement of high product yields from batch to batch, each load of wafers should undergo precisely the same environmental conditions for the same length of time. The microcontroller is provided for a single diffusion furnace and provides all necessary control and minitoring functions for the diffusion operation.

More particularly, the microcontroller provides all time bases including on-off control and ramping capability, precision control of temperature and gas flow, identification, acknowledgement and handling of alarm conditions, scanning of analog inputs, comparison of these inputs against stored values in memory and the display of errors, communication to peripheral devices and direct digital control of the operating parameters of time, temperature and gas flow. Four operating modes are provided; namely, program, remote, automatic and manual. In the program mode, the microcontroller RAM 46 can be loaded from the front panel keyboard 62 with data representing set points, timing intervals and other process parameters. In the remote mode, the stored data in RAM 46 can be transferred from the microcontroller to a remote computer or other peripheral device. Process recipes can be stored in the microcontroller by direct entry from the keyboard 62 or by loading from a remote computer or other source. In the automatic mode, the process cannot be changed but can be interrogated, and all process parameters are controlled in accordance with the values stored in RAM 46. In a manual mode, the diffusion furnace is disconnected from automatic control and the controllers 50, 52 and 54 may be manually set and timed.

The timing parameters for a diffusion cycle include control of both insertion and extraction of wafers, gas system control, and temperature system control including ramping of temperature from one value to another within a given time interval. The microcontroller provides timing information by dividing down the system clock 42 to convenient values, typically hours, minutes and seconds. A plurality of timing intervals is provided per diffusion cycle. In the illustrated embodiment, thirty intervals are typically provided, each with a time of one hundred hours divided into a resolution of one second.

The microcontroller also monitors alarm conditions by sensing (1) contact closure of switches of alarm sensors 58 associated with various alarm conditions such as tube over-temperature, stack over-temperature, open furnace doors, (2) excessive, compared to operator defined limits, temperature and gas deviations, and (3) other defined conditions as specified by the control programs. These conditions affect the quality of the process and can be continuously monitored to provide an indication of an alarm condition immediately upon its occurrence. Sensing of an alarm condition can also be employed to prevent commencement of an operating cycle, to abort a process cycle or alter a cycle in process, in addition to simply providing a warning indication of the condition.

The temperature scanner 32 is operative to monitor the inputs from an array of thermocouples disposed within the diffusion furnace and compare the monitored values with values stored in the RAM 46. Adjustment of the temperature is provided within a corresponding furnace zone via signals to power control 50 to obtain a desired operating level. If the monitored temperature differs by more than a predetermined deviation from the stored values, an alarm is denoted on display 70. Similarly, the microcontroller monitors via gas scanner 34 the inputs of an array of mass flow controllers and compared these monitored values with values stored in RAM 46 for adjustment of gas flow rate and indication of an alarm condition on display 70 if the monitored flow is outside of a predetermined tolerance range.

The microcontroller employs a universal asynchronous receiver-transmitter (UART) for communicating with peripheral devices. The front panel 10 of the microcontroller is arranged as a remote device which can be located remotely from the remainder of the controller, communication therebetween being provided using a standard data communication line. As a result, the controller can be mounted remotely from the furnace itself to conserve critical clean room space, while the front panel can be installed at any convenient control location.

Figure 2:
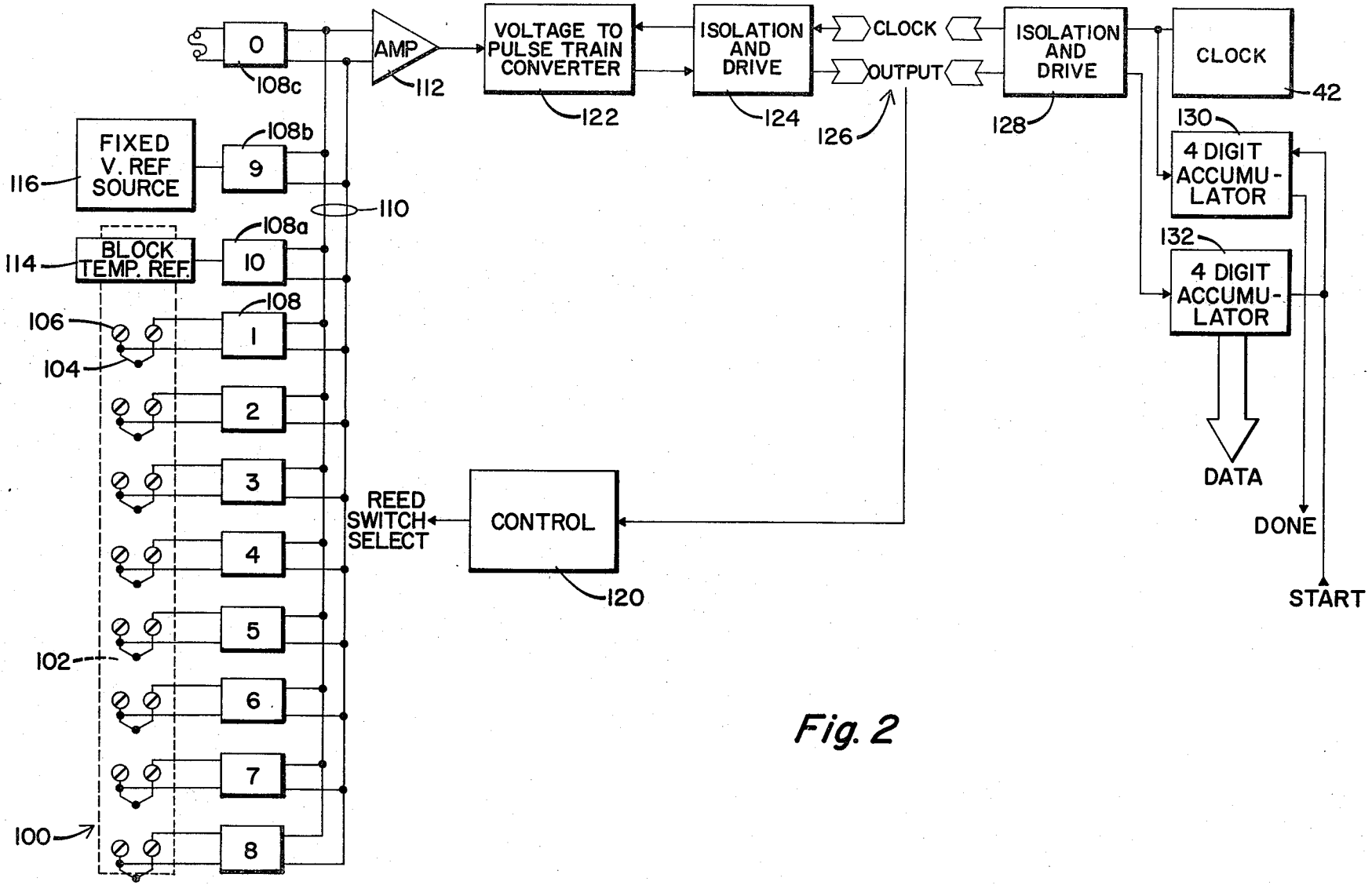
FIG. 2 is a block diagram of the temperature scanner of FIG. 1 and constructed in accordance with the invention.

The temperature scanner 32 is shown in FIG. 2 and includes a temperature sensing assembly 100 including a thermally conductive aluminum or other block 102 which is electrically insulated from terminals 106 but thermally coupled to cause the terminals to remain at a uniform temperature to prevent thermal gradients between any terminals and the block. A plurality of thermocouples 104 is connected to respective pairs of terminals 106 on block 102, each thermocouple disposed to sense a particular heater or process zone temperature in the diffusion furnace. In the illustrated embodiment, eight thermocouple channels are illustrated, each pair of thermocouple terminals being connected via a respective low-level reed switch or relay 108 to a two-wire line 110 for selective coupling to the input of an amplifier 112.

A block temperature reference 114 is secured to block 102 and includes an RTD element or other sensor mounted in the block and operative to sense the block temperature to provide a block temperature reference signal via associated reed switch 108*a* to two-wire line 110. The temperature of the block should be uniform and vary uniformly with changes in ambient temperature, such that sensor 114 represents the block temperature and therefore the cold junction temperature sensed by the thermocouples at the terminal pairs. The block temperature reference 114 and associated switch 108*a* define a cold junction channel. An amplifier reference channel is provided by a fixed voltage reference source 116 coupled to line 110 via an associated reed switch 108*b*. A short-circuit channel is provided by a short-circuit conductor 118 connected across the terminals of associated reed switch 108*c* which is also coupled to line 110. Thus, line 110 couples each of the channels in parallel to the input of amplifier 112. The reed switches are actuated by a control circuit 120 which is operative to selectively latch and unlatch each of the reed switches. The control circuit 120 receives command signals from the microprocessor and is operative to selectively actuate the reed switches for sequential coupling of the associated channels to the amplifier.

The output of amplifier 112 is coupled to a voltage-to-pulse train converter 122 which is coupled via a clock line and a date line to an opto-isolator 124. The isolator 124 has clock and data lines coupled, typically by a connector 126, to associated clock and data lines of the isolation and drive circuit 128 of the microprocessor scan control. The circuit 128 is driven by a clock 42 typically operative at 19.2 kHz. The clock is also coupled to a first four-digit reference accumulator 130. The data line from circuit 128 is coupled to a second four-digit accumulator 132, the output of which is in the form of parallel data coupled to the microprocessor bus 38. A start command is applied to both accumulators 130 and 132 from the microprocessor. A done command is provided by the accumulator 130 to the microprocessor bus 38.

The short-circuit channel provides a zero offset of amplifier 112. The reed switch 108*a* is actuated by control 120 to provide a short-circuit at the input of amplifier 112 which will yield, at the amplifier output, a zero offset signal which is stored in the microprocessor memory. This offset is subtracted from all other channel readings to correct for offset error. The fixed voltage reference source 116 provides an amplifier input signal of predetermined value. The output which is obtained as a result of this input signal is stored in the microprocessor memory as gain and is used in the computation of the thermocouple temperature. The cold junction channel provides a measure of the temperature of block 102. The block temperature reference is calibrated to match the thermocouple characteristics over the operating temperature range to which the cold junction (block) is subjected. The output signal from the cold junction channel, after calibration, is added to the signal from signal channels 1–8 so that the thermocouple output voltage is provided which is referenced to 0° C. In order to read the channels 1–8, the offset is subtracted from the thermocouple voltages, this corrected result being divided by the gain correction, and to this result is added the adjusted cold junction output in order to provide a corrected output voltage for heater control. A modified piecewise linear approximation of the thermocouple characteristic, or other conversion, is employed to convert thermocouple voltage to degrees for display. The computations are performed by the microprocessor using computerized techniques well known in the art and which themselves form no part of the invention.

Data collection is accomplished in the following manner. The microprocessor causes control 120 to latch one of the reed relays 108 to thereby select one of channels 1–8. The thermocouple voltage for the selected channel is applied to amplifier 112 and the amplifier output voltage is converted by connector 122 to a pulse train, the frequency of which is representative of voltage amplitude. The output frequency of converter 122 is equal to the clock frequency multiplied by the amplifier output voltage divided by a constant. A start signal clears both accumulators 130 and 132 and initiates their counting operation. After a predetermined number of clock pulses, say 10,000, the accumulator 130 overflows, setting the done flag and freezing the count present in accumulator 132 which is then the data output. This data is a four-decimal digit code representing the voltage at the output of amplifier 112. The data is read into the random access memory 46 of the microprocessor, and the switch 108 of the thermocouple channel which has just been read is unlatched by control 120 and the cycle continues in scanning each channel in turn.

The gas scanner 34 is similar in its operation to the temperature scanner to provide data representing gas flow to the microprocessor for display and control purposes. In place of the temperature sensing assembly 100, there is provided a gas sensing assembly for measuring the flow rates from several sensing points. Such flow measurement can be provided by well-known transducers such as mass flow controllers, and no compensating techniques need by employed as with the temperature sensing described above.

Figure 3:
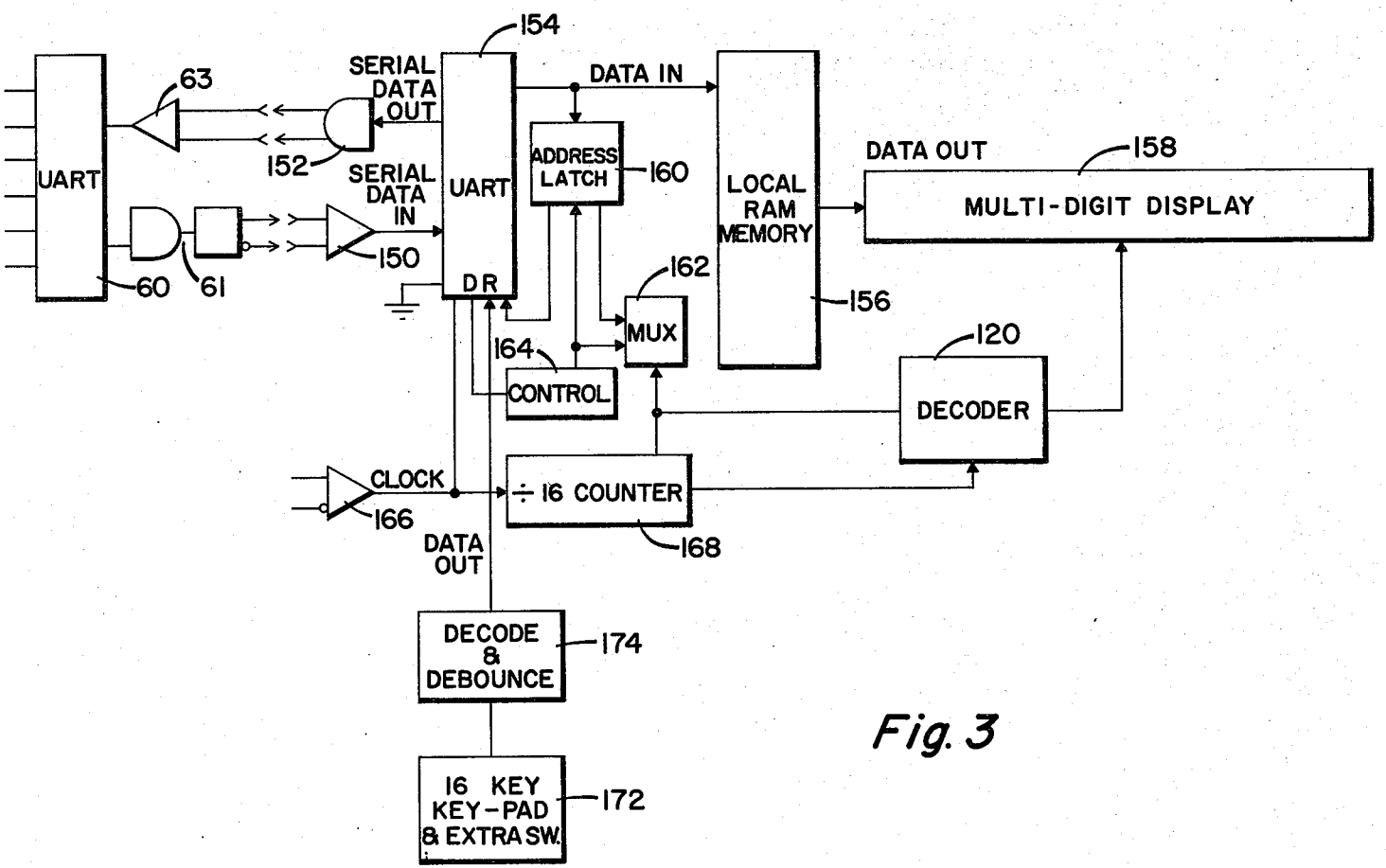
FIG. 3 is a block diagram of the front panel logic of FIG. 1 and constructed in accordance with the invention.

The remote front panel 10 is shown in FIG. 3 and includes a differential receiver 150 and a differential driver 152 coupled by a two-wire communication line to the UART 60, which includes a differential driver 61 and receiver 63. The receiver 150 provides serial data to the UART 154, while serial data is provided by the UART 154 to the differential driver 152 for transmission to UART 60. Parallel data is provided by UART 154 to a local random access memory 156 which in turn provides parallel data to the multidigit display 158. The parallel data from UART 154 is also applied via an address latch 160 to a multiplexer 162 which provides a multiple bit address to memory 156. The DR control line from UART 154 is also coupled to a counter 164, the output of which is applied to address latch 160 and to multiplexer 162. The parity select terminal of UART 154 is hard-wired to one state, such as ground.

A differential receiver 166 receives clock information from the remote driver and provides clock signals to a divide-by-sixteen counter 168 which provides output signals to the multiplexer 162 and to a decoder circuit 170 which is coupled to the multidigit display 158. The display is typically a multisegment numerical indicator and the data from random access memory is applied to the segment anodes, while the output signals from decoder 170 are coupled to the cathodes of the displays such that the decoder 170 also serves as a character decoder. The keypad and entry switches 172 are connected to decoder and debounce logic 174, the output of which is applied to the input terminal of UART 154.

The remote display can be easily provided as a remote panel since only six wires are required to couple the front panel to the rest of the controller. If a differential signal format is not employed, then only three wires need be used.

The remote display is operative to provide effectively nine bits of data from a standard eight-bit teletypewriter line. The parity state of the driver UART 60 is employed as the ninth bit. The parity select terminal of UART 154 is opposite in logical state to the parity select signal state of UART 60, such that a parity error bit is produced as the ninth data bit at the receiver. For address rather than data purposes, the parity select signal states of the transmitter and receiver are the same such that no parity error bit is produced. The control circuit 164 in the receiver is coupled to the clock terminal of address latch 160 or random access memory 156 depending on the parity error bit. The decoder provides two write commands, write zero and write one, to the parity select terminal of the transmitter UART 60 depending on whether address or data is to be transmitted. When a character is received by UART 154, the presence of a parity error bit causes data to be loaded into memory 156 at the latched character address. If no parity error bit is present, data is loaded into address latch 160 to identify the character address of the next character data entry.

Figure 4:
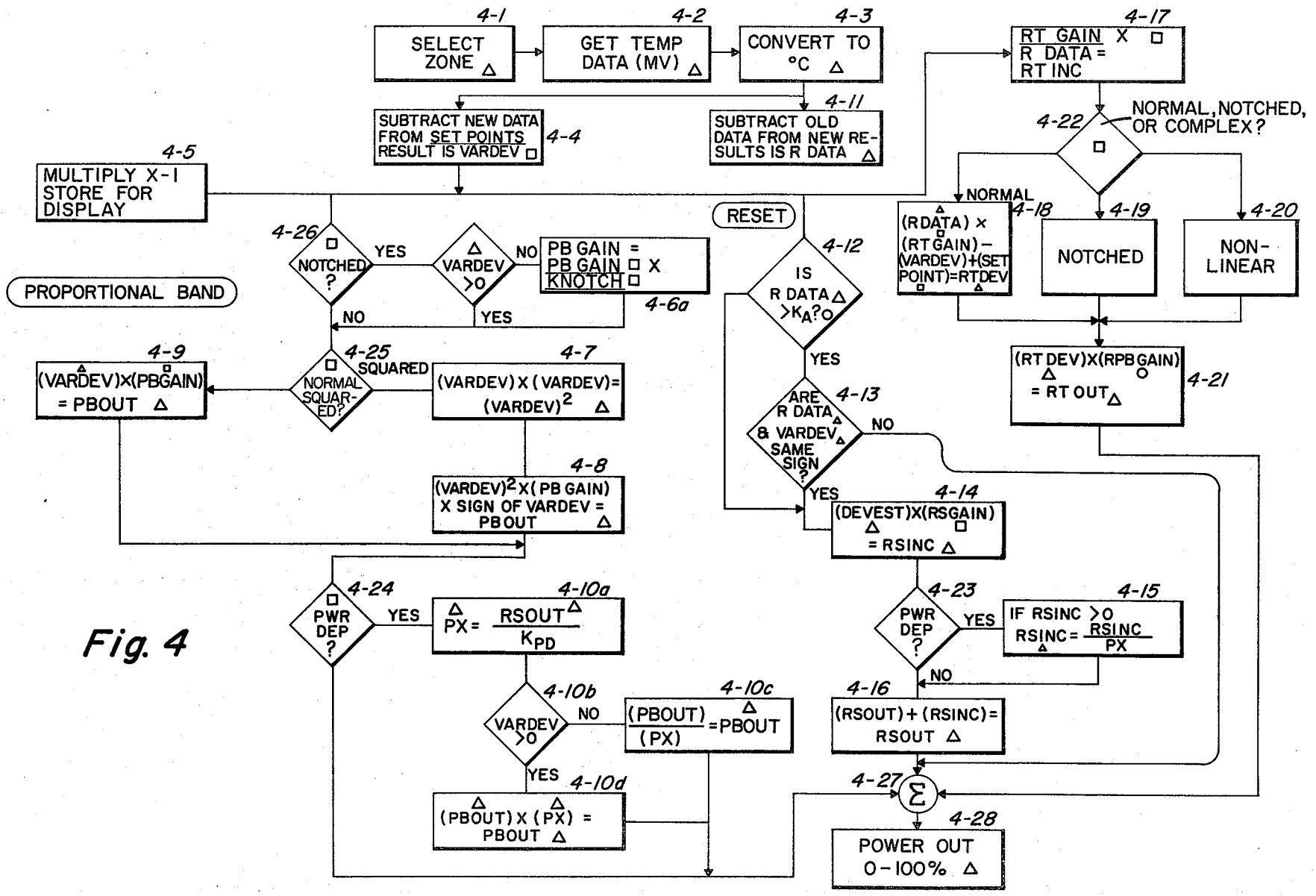
FIG. 4 is a flow chart of a three mode process control algorithm employed in the invention.

A flow chart is shown in FIG. 4 of a three-mode control algorithm for controlling output power for the heaters. The three modes of computing power output are proportional band, reset or integral, and rate or derivative mode, respectively. The proportional band mode computes power output as a function of deviation of measured temperature from a predetermined set point. The reset or integral mode computes power as a function of the integral of deviation. The rate or differential mode computes power as a function of the derivative of deviation. Three mode control is generally known in the process control field. The three mode control illustrated herein is specifically adapted for use in the microprocessor system hereindescribed for temperature control of a diffusion furnace. Each mode contributes to the power applied to the heaters. Power is applied to the heaters in the form of pulses, the pulse characteristics of which are varied to produce an intended power level. In operation, the controller scans each zone of the furnace at a predetermined rate, and for each zone, temperature is measured and compared with the stored set points to provide, according to the process of FIG. 4, power output pulses to the zone heaters.

Figure 5:
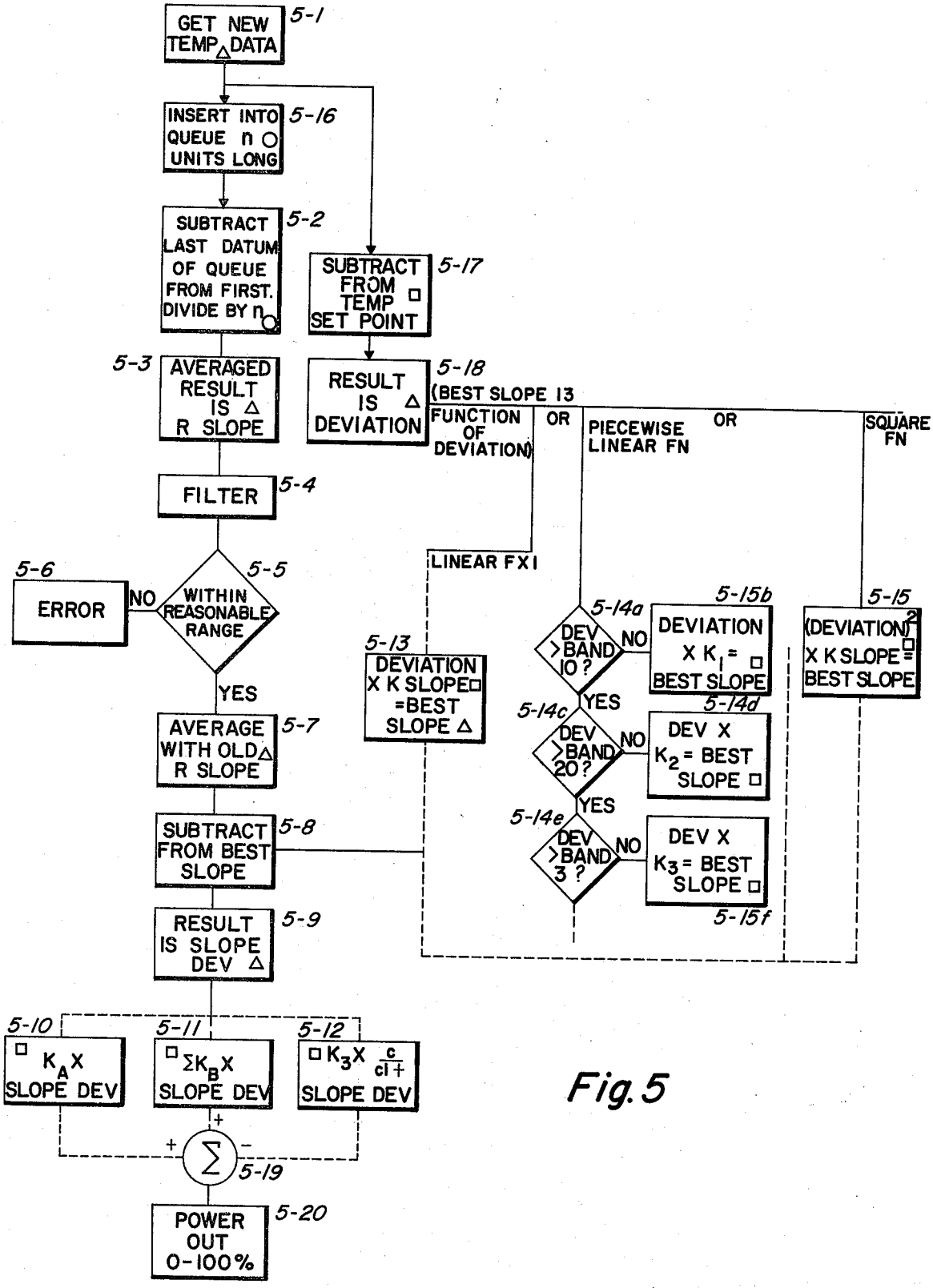
FIG. 5 is a flow chart of an alternative process control algorithm employed in the invention.
Figure 6:
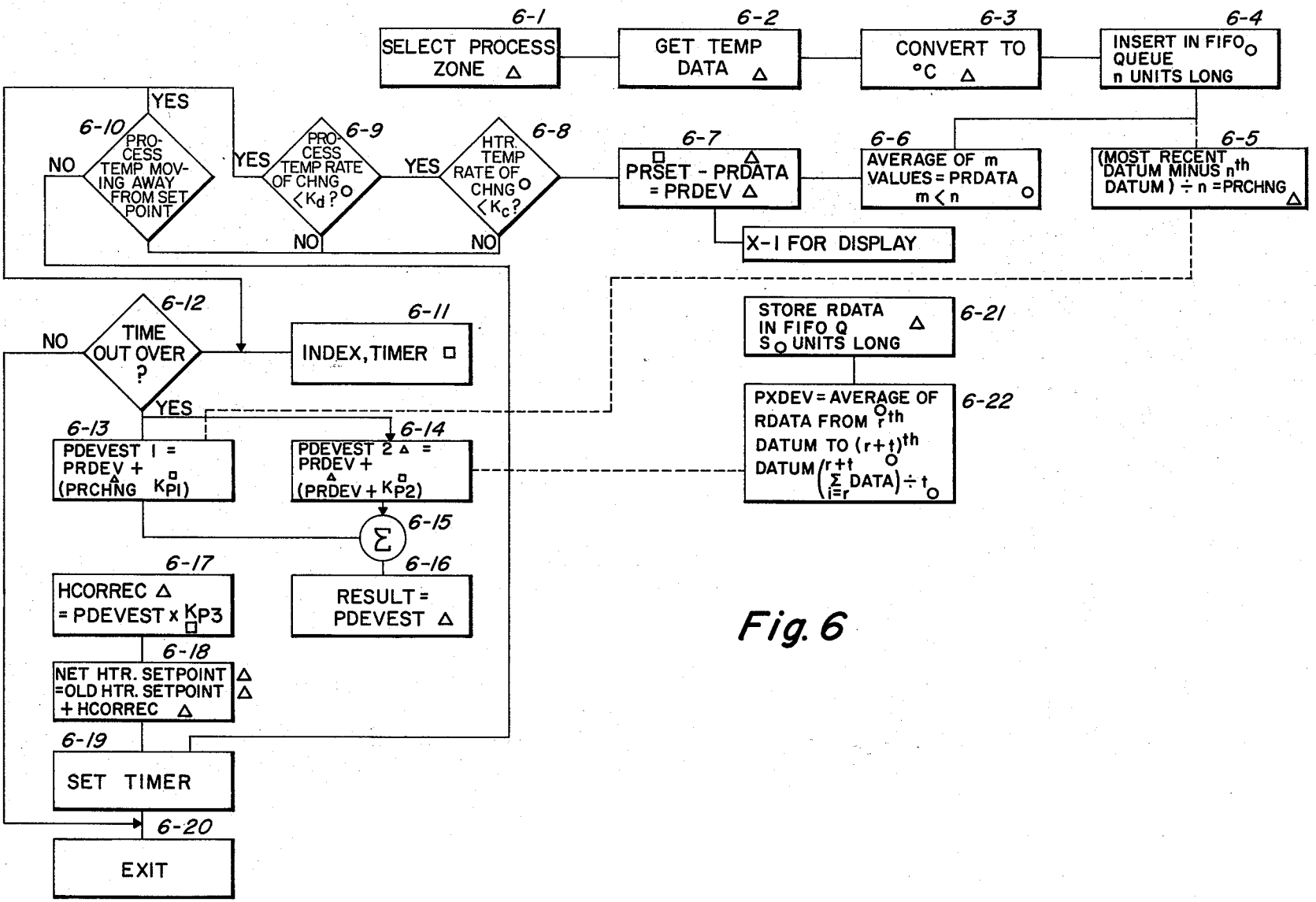
FIG. 6 is a flow chart of a profile control algorithm employed in the invention.

In the flow chart of FIG. 4, as well as in the flow charts of FIGS. 5 and 6 to be described, three symbols are employed to denote different types of data entered into or employed in the system. The symbol □ denotes operator alterable data which is stored in the random access memory 46 of the microprocessor. This data can be entered by way of the front panel keyboard 62 or by other sources such as a remote terminal or disc. The symbol ○ denotes data in the microprocessor read-only memory 44 which is constant and therefore not alterable by an operator. The symbol Δ denotes data in the random access memory 46 which is internally variable by the microprocessor.

Referring to FIG. 4, a zone is selected (4-1) and the proper channel of the temperature scanner (FIG. 2) is selected to read temperature data from that channel (4-2). This temperature data is present as a binary number representing microvolts of thermocouple output, and this binary number is converted to °C. (4-3) by a modified piecewise linear approximation or other appropriate temperature conversion algorithm. The number representing the measured temperature in °C. is subtracted from the appropriate set point to provide a temperature deviation labeled VARDEV (4-4), which is the then present temperature deviation for the particular zone. It should be noted that the signal of VARDEV is by convention opposite to that which would be normally expected. A positive VARDEV denotes a temperature below the set point, while a temperature above the set point is denoted by a negative VARDEV. For purposes of display of deviation, the VARDEV value is multiplied by minus one (4-5) to be of correct sign for display. Thus, a temperature below the set point is displayed as a negative deviation, while a temperature above the set point is displayed as a positive deviation.

In the proportional band mode, a normal, squared or notched characteristic can be selected by the operator to provide an intended function of the deviation. For the normal characteristic, the deviation VARDEV is multiplied by PBGAIN (4-9), which is a constant entered by the operator, and of value to provide an intended PBOUT which is the contribution of the proportional band mode (4-27) to the power applied to the heaters (4-28). The squared characteristic provides PBOUT equal to the square of the deviation, with the sign being preserved. As illustrated, the value of VARDEV is squared (4-7) and the squared result is multiplied by PBGAIN and by the sign of VARDEV to provide PBOUT (4-8).

For the notched characteristic, a proportional band is provided that has a different characteristic for actual temperature above the set point than for temperature below the set point to accommodate the fact that the maximum rate of cooling and the maximum rate of heating tend to be different in most heating processes. The notched characteristic can be used with either normal or squared proportional band computation. For notched control, the PBGAIN is multiplied by an adjustable notch factor (**4-6*a***) when VARDEV is negative; that is, when the temperature is above the set point.

If power-dependent control is selected by the operator (4-24), any positive value of PBOUT is multiplied by an augmenting factor related to the total power necessary to maintain the current temperature. Any negative value of PBOUT is divided by the same factor. This control mode reflects the fact that as more power is required to maintain temperature, a greater power increment is required for each unit of temperature rise and a lesser increment for each unit of temperature decrease. RSOUT is a measure of the power necessary to maintain temperature since at zero duration and zero rate of change, both PBOUT and RTOUT are zero, therefore if power-dependent control is selected by the operator (4-24), the power PBOUT is altered by a factor PX, which is equal to RSOUT divided by a constant (**4-10*a*). If VARDEV is greater than zero (4-10*b*), signifying negative deviation, the value of PBOUT is multiplied by the factor PX (4-10*d*) to yield the corrected value of PBOUT for application to the heaters. If VARDEV is less than zero, signifying a positive deviation, the value PBOUT is divided by the factor PX (4-10*c***) to provide the corrected value of PBOUT.

The result of the proportional band computation yield a value PBOUT which is the contribution of the proportional band mode to the power output being applied to the zone heaters. If the deviation is zero, PBOUT is zero.

The reset mode is employed under specified conditions and is disabled under other conditions when this mode of control will result in overshoot or instability in heater control. The data from the previous temperature conversion step (4-3) is subtracted from the new data to provide an output RDATA (4-11) which represents the rate of change of temperature. If RDATA is greater than a constant (4-12), a determination is mode of whether RDATA and VARDEV are the same sign (temperature rising or falling beyond the setpoint) (4-13). If so, the estimated deviation, DEVEST, is multiplied by the constant RSGAIN to provide RSINC (4-14), which is an integral value which will be added to the total integral RSOUT (4-16). The value RSINC can also be corrected for power dependency by a process (4-15) similar to the process of 4-10 described above.

The reset mode is operative if the rate of change of temperature is less than a constant or if the rate of change of temperature is away from the set point. Even if either condition is present, if the total three-mode control is already specifying full power, when VARDEV is positive, or zero power when VARDEV is negative, then the reset mode is not enabled. Thus, the reset mode is disabled under conditions in which it will cause overshoot, and is enabled only when the proportional band is not already able to achieve control. In addition, the reset mode is disabled to prevent saturation in any instance when the total control algorithm is already providing maximum control to reach the set point. This technique avoids a common problem with conventional controllers wherein the controller is turned on before the actual heater power, resulting in a large integration value and large overshoot when the heaters are switched on.

The rate mode provides control as a function of the rate of change of temperature. The rate of change of temperature RDATA is multiplied by a constant representing a selected time interval RTGAIN to provide an anticipated change RTINC (4-17). A normal, notched or non-linear control characteristic can be selected (4-22) to provide by respective computations an anticipated deviation RTDEV (4-18, 4-19 and 4-20). This anticipated deviation is multiplied by a constant RPB to yield a value RTOUT (4-21) which is the rate mode contribution to power output. The non-linear or complex rate alters RTGAIN as a function of closeness to the set point.

The system is also operative according to the control algorithm shown in the flow chart of FIG. 5 wherein the rate of change of temperature is controlled, rather than minimizing deviation, such that a predetermined rate is obtained. In controlling toward a set point, the algorithm of FIG. 5 permits the system to vary about an optimum path rather than varying about the actual set point. The process is self-calibrating in that a given deviation will cause the controller to alter heater power until a given rate is obtained. This is in distinction to conventional control techniques which specify a power change as a function of deviation, but the actual rate of change of which will vary with temperature, mass, furnace insulation and the like, requiring careful adjustment of the entire system for optimum performance. By the present technique, once a rate of change of temperature is determined, control will tend to approach this rate which already takes into account the system characteristics. Referring to FIG. 5, temperature data is obtained from a selected channel of a selected furnace zone and this data is inserted into a data queue in the microprocessor RAM (5-16). The last datum of the queue is subtracted from the first datum and divided by n (5-2) to provide a result FRSLOPE which is the average rate of change of temperature (5-3). The FRSLOPE data is averaged (5-4) to filter out noise and is then compared with predetermined limits to determine whether the data is within reasonable range (5-5). If not within reasonable range, an error is indicated (5-6). If within resonable range, the averaged FRSLOPE is averaged with the previously computed RSLOPE (5-7) to filter out erroneous readings. The result is then substracted from BESTSLOPE (5-8) to yield SLOPEDEV (5-9) which is the deviation of the actual rate of change of temperature from the intended optimum rate of change (BESTSLOPE). Power output to the furnace heaters is varied as a function of SLOPEDEV (5-10), the integral of SLOPEDEV (5-11) and the derivative with time of SLOPEDEV (5-12).

The optimum rate of change of temperature BESTSLOPE is a function of deviation and can be computed in one of three ways, which can be selected by the operator or preprogrammed. The present temperature data is subtracted from the set point (5-17) to yield temperature deviation (5-18). If BESTSLOPE is computed as a linear function of deviation, the deviation is multiplied by a constant (5-13). If a piece-wise linear function is selected (**5-14*a*–5-14*f*), different bands of deviation are provided and within each band the slope is determined. A determination is made whether the deviation is greater than the predetermined band 1 deviation (5-14*a*). If not, the deviation is multiplied by a constant to yield BESTSLOPE (5-14*b*). If yes, a determination is made of whether the deviation is greater than the predetermined band 2 deviation (5-14*c*). If not, the deviation times a constant yields the BESTSLOPE (5-14*d*). If yes, then a determination is made whether deviation is greater than the band 3 deviation (5-14*e***). If not, the BESTSLOPE is determined by the deviation times a constant. The processing can continue in similar manner for an intended number of deviation bands within each of which BESTSLOPE is determined.

A square function can also be employed to determine BESTSLOPE. The deviation is squared and multiplied by a constant (5-15) for this computational mode.

The microcontroller provides automatic profile adjustment of temperature in the diffusion tube to maintain intended temperature levels in respective process zones in the tube. Thermocouples are located in the tube at respective process zones for monitoring of zone temperatures. The operator enters the temperature desired for each zone and the microcontroller is operative to automatically adjust the heater power for each zone to maintain the intended zone temperatures. The microcontroller is employed in a first control loop in which the heater temperature is controlled in accordance with an appropriate algorithm, such as depicted by the flow chart of FIG. 6, to maintain intended process temperatures within the diffusion tube. Referring to FIG. 6, temperature data is collected in the same manner as described above except that the selected channels of the temperature scanner correspond to process zones within the diffusion tube, the temperature of which is sensed by process thermocouples disposed in the tube. This is in distinction to the thermocouples previously described above which are disposed outside of the diffusion tube in a position to sense heater temperature.

The temperature data from a selected process zone (6-1 and 6-2) is converted to °C. (6-3) and is averaged with previous values of temperature for the selected zone to provide a value PRCHING which is the average of the process temperature for n samples. The present temperature data is applied to a first-in first-out queue n units in length (6-4) and the average is computed by subtracting the oldest datum from the most recent datum and dividing by n to yield the result PRCHNG. The most recent constituents of the queue, m in number, are averaged (6-6) to provide a value PRDATA. The averaging of n and m temperature measurements is to eliminate spurious values and provide reliable temperature values for employment in subsequent computation. The deviation PRDEV is computed (6-7) by subtracting the temperature average PRDATA from the set point PRSET for the selected zone. The deviation value can be multiplied by −1 for display.

A series of boundary checks are made to determine whether the controlling heater set point for the selected zone should be adjusted. If the heater thermocouple temperature rate of change is less than a constant (6-8), and if the process thermocouple temperature rate of change is less than a constant (6-9), the heater set point adjustment procedure continues. If either determination of steps (6-8) and (6-9) is no, then a determination is made whether the process temperature is moving away from the set point (6-10). If yes, the set point adjustment procedure continues. If no, then a timer is set (6-19). The timer provides a time interval during which no set point adjustment is made. The time interval is usually specified by a user programmable digital counter which is indexed through its sequence of counts (6-11) and a determination is made (6-12) whether or not the time interval has elapsed. If the rate of change of the heater or process temperature is greater than the specified constants, no adjustment of the set point is made, since the system is assumed to be in a dynamic state. However, if the process temperature is diverging from the set point, then adjustment is made to correct for the increasing deviation.

After the timing interval has elapsed (6-12), an anticipated deviation is computed which is an estimate of a present correction of heater power which is required to achieve an intended process zone temperature at a specified time period later. The present deviation PRDEV is added to the current rate of change PRCHNG multiplied by a constant KP1 to yield a value PDVEST1 (6-13) which is an estimate of what the deviation will be in KP1 minutes, assuming that the rate of change remains the same. The current deviation PRDEV is also added to the average change in heater temperature RXDEV multiplied by a constant to yield the value PDEVEST2 (6-14) which is an estimate of what the deviation will be assuming a change in rate. The values PDEVEST1 and PDEVEST2 are summed (6-15) to produce a value PDEVEST (6-16) which is the anticipated deviation of the set point. This value is multiplied by a constant to yield a correction factor HCORREC (6-17) which is added to the previous heater set point to yield the new heater set point (6-18) necessary to provide an intended process temperature in the diffusion tube.

The average heater temperature deviation PXDEV is computed in the manner shown in steps (6-21) and (6-22). The rate of change of temperature RDATA is applied to a first-in first-out queue s units long and is averaged to provide the value PXDEV.

In response to selected alarm conditions, an abort or escape sequence can be provided by the microcontroller which permits the control process to jump to an intended step in the process sequence. The random access memory of the microcontroller includes a table of alarm conditions and associated destinations to which the process will jump in response to associated alarm conditions. In response to an alarm condition, the process can continue according to an alternate recipe path or orderly termination of the process can be accomplished to prevent damage to either the furnace system or the wafers being processed. Such alternative processing sequences can be readily provided simply by appropriate control data in the memory which is operative in accordance with the associated control program.

The invention is not to be limited by what has been particularly shown and described except as indicated in the appended claims.

What is claimed is:

1. A control system for a diffusion furnace comprising:

a plurality of temperature sensors operative to sense temperature in respective zones of the furnace;

a temperature scanner operative to selectively scan said temperature sensors and provide signals representative of temperature sensed by respective ones of said sensors;

a microprocessor including a random access memory and a read-only memory;

first means operative to couple the signals from said temperature scanner to the random access memory of the microprocessor;

a heater power controller operative to provide power to the heaters of the zones of the furnace;

second means coupling the microprocessor to the heater power controller for providing control signals therefor; and a front panel including operating controls and indicators for manual entry of numerical and control information and for display of operating and status information.

2. The system of claim 1 including:

a gas scanner operative to selectively scan a plurality of gas flow monitors and to provide signals representative of sensed gas flow;

a gas controller operative to apply control signals for regulation of gas flow in the furnace zones;

a boat speed controller operative to provide control signals for governing the speed of boat movement through the furnace;

said first means being operative to couple signals from said gas scanner and from said boat monitor to the random access memory of the microprocessor.

3. The system of claim 1 wherein said front panel includes:

a keyboard and operating switches for manual entry of numerical and code data;

a switch encoder coupled to said keyboard and operating switches and operative to provide signals representing particular keyboard and switch actuation;

a UART coupled to a communication line and operative to convey the signals from the switch encoder over the communication line to the microprocessor;

a local memory coupled to the communication line and operative to store data from the microprocessor conveyed over the communication line; and display means operative to display data from said local memory for indication of numerical and status information.

4. The system of claim 1 wherein said temperature scanner includes:

a thermally-conductive block having a plurality of terminal pairs thermally coupled to the block and electrically insulating therefrom such that the terminal pairs are at a uniform temperature;

a plurality of thermocouples each connected to a respective terminal pair and each disposed to sense a particular temperature in the diffusion furnace;

a block temperature reference means operative to sense the temperature of the block and to provide a block temperature reference signal;

a voltage reference source;

a short circuit source;

a plurality of reed switches each coupling a respective thermocouple via a common line to the input of an amplifier;

a reed switch coupling said voltage reference source to the common line;

a reed switch coupling the short circuit to the common line.

5. The system of claim 1 wherein said temperature scanner includes:

a cold junction channel including a block temperature reference and associated reed switch coupled to a common line;

a reference channel including a fixed voltage reference source and associated reed switch coupled to the common line;

a short circuit channel including a short circuit conductor and associated reed switch coupled to the common line.

6. The system of claim 5 wherein said temperature scanner further includes:

said amplifier having its input coupled to the common line and providing an output voltage to a converter circuit operative to provide pulses of a frequency representative of the output voltage of the amplifier;

means coupling the pulses from the converter means to the microprocessor;

control means operative in response to data from said microprocessor to selectively actuate the reed switches for sequential coupling of the associated channels to the amplifier;

the short circuit channel provides a zero offset voltage at the amplifier output, a representation of which is stored in the microprocessor memory and which offset is subtracted from the other channel readings to correct for offset error;

the reference channel provides an amplifier output of predetermined value, a representation of which is stored in the microprocessor memory and employed in the temperature computation as a gain correction;

the cold junction channel provides an amplifier output which is a measure of the block temperature and a representation of which is stored in the microprocessor memory for temperature computation.

7. The system of claim 6 including:

an isolation and drive circuit having a clock line for coupling clock signals to the temperature scanner and a data line for coupling pulses from the temperature scanner to the microprocessor;

clock means for providing clock signals to the isolation and drive circuit;

a first accumulator receiving clock signals from said clock means;

a second accumulator receiving data signals from the data line of said isolation and drive circuit and operative to provide output data representing temperature in each of the thermocouple channels;

the first and second accumulators being actuated in response to a start command;

the second accumulator being stopped in response to a done command from the first accumulator;

the first accumulator operative to count to a predetermined number of clock pulses and to discontinue the counting operation of the second accumulator which is representative of the temperature sensed by the associated thermocouple.

8. The system of claim 6 including:

means for receiving pulses from the temperature scanner to provide data representing temperature sensed by each of the thermocouple channels.

9. The system of claim 1 wherein said heater power controller is operative to provide pulsed power to said heaters.

10. The system of claim 9 wherein said front panel includes indicators which are pulsed at the same rate as the pulsed power applied to said heaters to denote the rate of power being applied.

11. The system of claim 1 further including one or more alarm sensors operative to sense an alarm condition in the furnace and to provide corresponding alarm signals.

12. The system of claim 1 including:

communication means coupling the microprocessor to the front panel and including;

transmission means coupled to a transmission line over which serial data is conveyed to and from the microprocessor;

a local memory coupled to said transmission means for storage of data received therefrom;

display means operative to display data from the local memory;

a keyboard and operating switches for manual entry of numerical and code data; and a switch encoder coupled to said keyboard and operating switches and operative to provide to the transmission means signals representing particular keyboard and switch actuation.

13. The system of claim 12 further including control means operative in response to a parity error bit to cause loading into the local memory of data representing a character to be displayed, and operative in the absence of a parity error bit to load into an address latch the address of the next character to be displayed.

14. The system of claim 3 wherein said microprocessor can be coupled to a remote data system for transfer of data to or from the microprocessor.

15. The system of claim 11 wherein said microprocessor is operative upon predetermined alarm conditions to transfer the control process to a selected cycle as specified by data in the random access memory.

16. A control system for a diffusion system furnace comprising:

a plurality of temperature sensors operative to sense heater temperature and process temperature in respective zones of the furnace;

a temperature scanner operative to selectively scan said temperature sensors and provide digital signals representative of temperature sensed by respective ones of said sensors;

a microprocessor including a random access memory and a read-only memory;

a front panel including operating controls for manual entry of numerical and control information, and indicators for display of operating and status information;

means operative to enter data provided by said operating controls into the random access memory;

means operative to couple data derived from said digital signals to the random access memory;

a heater power controller operative to provide power to the heaters of the furnace zones; and means coupling the microprocessor to the controller for providing control signals therefor.

17. The system of claim 16 wherein said microprocessor is operative to compute power output to be applied to the furnace heaters in accordance with a three mode control algorithm.

18. The system of claim 16 wherein said microprocessor is operative to compute power output to be applied to the furnace heaters in accordance with a predetermined rate of change of temperature.

19. A diffusion furnace control system comprising:

one or more temperature sensors in the diffusion tube of the diffusion furnace and operative to monitor the temperature of respective process zones along the tube;

one or more temperature sensors disposed at the heaters of the furnace and operative to monitor the temperature of the heaters for each furnace zone;

first control means coupled to the tube temperature sensors and operative to measure the deviation of temperature in each zone of the tube from the set point temperature for each zone;

means for determining whether the set points should be adjusted; and second control means operative in response to a determination that set point should be adjusted to control power to the heaters to provide an intended set point for each process zone.

20. A process for control of temperature in a diffusion furnace comprising:

measuring the temperature in each zone of a diffusion furnace tube;

determining the average rate of change of temperature in each zone;

determining if the average rate of change of temperature for each zone is within a predetermined tolerance range;

denoting an error condition if the average rate of change of temperature is not within the tolerance range for that zone;

providing the optimum rate of change of temperature;

comparing the average rate of change of temperature with the optimum rate to provide a measure of the deviation therebetween; and providing output signals which are a function of the deviation for control of the heaters of each furnace zone.

21. A process for control of temperature in a diffusion furnace comprising:

measuring the temperature in each furnace zone;

comparing the measured temperature in each zone with a predetermined set point to provide a temperature deviation for each zone;

providing a predetermined gain characteristic;

providing output signals as a function of deviation and gain characteristic;

providing a measure of the rate of temperature change;

providing output signals as a function of the rate of change; and deriving from the rate of change output signals which are representative of anticipiated deviation.

* * * * *